US008167123B2

(12) United States Patent
Lai

(10) Patent No.: US 8,167,123 B2
(45) Date of Patent: May 1, 2012

(54) BARREL

(76) Inventor: Ming-Hsiao Lai, Chang-Hua Hsien (TW)

( * ) Notice: Subject to any disclaimer, the term of this patent is extended or adjusted under 35 U.S.C. 154(b) by 0 days.

(21) Appl. No.: 13/078,437

(22) Filed: Apr. 1, 2011

(65) Prior Publication Data

US 2011/0174646 A1 Jul. 21, 2011

Related U.S. Application Data

(63) Continuation-in-part of application No. 12/211,081, filed on Sep. 15, 2008, now abandoned.

(51) Int. Cl.
*A45D 44/18* (2006.01)

(52) U.S. Cl. ..... 206/15.3; 206/361; 220/620; 220/689

(58) Field of Classification Search ..... 206/15.2, 206/15.3, 209, 209.1, 361, 362, 362.1–362.3; 220/615, 619, 620, 677, 682, 689, 690, 691, 220/697, 698, 908; 229/5.5, 5.6, 5.8
See application file for complete search history.

(56) References Cited

U.S. PATENT DOCUMENTS

| | | | | |
|---|---|---|---|---|
| 3,949,927 | A * | 4/1976 | Smith et al. | 220/620 |
| 4,303,190 | A * | 12/1981 | Ditto et al. | 220/620 |
| 6,165,115 | A * | 12/2000 | Rea | 220/620 |
| 7,156,252 | B2 * | 1/2007 | Morin | 220/619 |
| 7,191,897 | B2 * | 3/2007 | Lai | 206/15.3 |
| 7,273,155 | B1 * | 9/2007 | Gray | 220/908 |
| 2002/0158071 | A1 * | 10/2002 | Chasteen et al. | 220/619 |
| 2004/0074911 | A1 * | 4/2004 | Stodd | 220/619 |
| 2008/0156680 | A1 * | 7/2008 | Lai | 206/361 |

* cited by examiner

*Primary Examiner* — Luan K Bui
(74) *Attorney, Agent, or Firm* — Egbert Law Offices PLLC

(57) ABSTRACT

A barrel has an external metal cylinder and a plastic vessel. The external metal cylinder has a cylinder body, an open top and an open bottom. The plastic vessel has an inner space with a sealed bottom as well as a through top flange. The top flange of the plastic vessel is sleeved tightly into the external metal cylinder, and embedded into the internal curling portion formed by the open top of external metal cylinder. Moreover, the sealed bottom of the plastic vessel is extended into the open bottom of the external metal cylinder, and kept with a recessed spacing to the curling flange, while the bottom of the external metal cylinder is exposed. The barrel can be applied to toilet brush assemblies in order to reduce the manufacturing cost, prevent rust and facilitate the cleaning process with better economic benefits and applicability.

3 Claims, 7 Drawing Sheets

BARREL

CROSS-REFERENCE TO RELATED U.S. APPLICATIONS

The present application is a continuation-in-part of application Ser. No. 12/211,081, filed on Sep. 15, 2008, now abandoned.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates generally to a barrel, and more particularly to an innovative one which is composed of an external metal cylinder and a plastic vessel positioned at the top of the structure.

2. Description of Related Art Including Information Disclosed Under 37 CFR 1.97 and 37 CFR 1.98.

The conventional barrel products still have some disadvantages. For instance, the barrel structure of toilet brush assembly as shown in FIGS. 1 and 2, wherein the barrel 11 of a typical toilet brush assembly 10 is composed of a metal cylinder 111 and a metal bottom plate 112. A cup is placed into the barrel 11 to accommodate the sewage released from the toilet brush 13. However, the following shortcomings are observed during actual applications:

First, a metal bottom plate 112 must be assembled at the bottom of metal cylinder 111 of the barrel 11, leading to substantial increase of metal materials' cost. The metal cylinder 111 shall be assembled onto the metal bottom plate 112 through a special procedure (e.g. punching or rolling), thus increasing the manufacturing cost along with lowered manufacturing efficiency.

Second, if the inner space formed by the metal cylinder 111 and metal bottom plate 112 of the barrel 11 is used to accommodate the sewage released from the toilet brush 13, corrosion, fracture or damage will occur rapidly. Hence, a cup 12 is arranged into the barrel 11, leading to increase of material cost. Moreover, since a gap still exists between the cup 12 and metal cylinder 111, residual water on the wall of cup 12 and metal cylinder 111 will possibly bring about corrosion at the joint of the metal bottom plate 112 and metal cylinder 111.

Third, as the cup 12 of typical barrel 11 is used to accommodate the sewage released from the toilet brush 13, it is required to take out the cup 12 manually from the barrel 11 when it is intended to clean up the sewage, leading to inconvenience of operation and difficulty of cleaning because of limited inner space of the barrel 11.

Fourth, as illustrated in related U.S. Pat. No. 3,800,994, a convex ring flange is recessed onto the tubular body adjacent to the lower part of the curling portion, and the cylinder is inserted into the tubular body, such that the inner wall of the convex ring flange is clamped onto external wall of the cylinder. In such a case, an annular recessed space is formed between the convex ring flange and the cylinder, so dirt is accumulated and germs are bred to create trouble in routine cleaning.

Fifth, as illustrated in the related U.S. Pat. No. US2004/0262171A1, the bottom of the internal cylinder is extended to the lower opening of the external cylinder during the rolling process, the curling flange of the lower opening may contact frictionally with the bottom of the internal cylinder, leading to damage of the internal cylinder. Moreover, as the top and bottom of the internal cylinder are only abutted with the curling flange of the upper and lower openings of the external cylinder, the internal cylinder cannot be positioned stably when the curling flange of external cylinder is subject to roller forming. In such a case, the curling flange of the upper and lower openings must be rolled separately to form an abutting position for the internal cylinder, thus leading to lower manufacturing efficiency.

Thus, to overcome the aforementioned problems of the prior art, it would be an advancement if the art to provide an improved structure that can significantly improve the efficacy.

Therefore, the inventor has provided the present invention of practicability after deliberate design and evaluation based on years of experience in the production, development and design of related products.

BRIEF SUMMARY OF THE INVENTION

FIGS. 3-4 depict preferred embodiments of the barrel of the present invention, which, however, are provided for only explanatory objective for patent claims. The said toilet brush assembly A includes a barrel 20, comprising of an external metal cylinder 21 and a plastic vessel 22. The external metal cylinder 21 is configured into a cylindrical body without a sealed bottom, and comprised of a cylinder body 211, an open top 212 and an open bottom 213. The plastic vessel 22 is made of plastic material with its longitudinal length shorter than that of the external metal cylinder 21, and comprised of an inner space 221 with sealed bottom 226 as well as a top flange 222. The sealed bottom 226 of the plastic vessel 22 is extended into the open bottom 213 of the external metal cylinder 21, and kept with a recessed spacing X (marked in FIG. 4) to the curling flange 214, while the bottom of the external metal cylinder 21 is exposed. Moreover, the top flange 222 of plastic vessel 22 and open top 212 of external metal cylinder 21 are integratedly positioned together.

A toilet brush 30 is provided, which comprises a handle 31 and a brush portion 32 at one end of the handle 31. The brush portion 32 can be arranged into the inner space 221 of the plastic vessel 22 of the barrel 20. The handle 31 protrudes from the top of the barrel 20.

A cover body 40 is arranged at a preset position of the handle 31 of the toilet brush 30. The cover body 40 can be covered onto the open top 212 of external metal cylinder 21 of the barrel 20, thereby positioning the toilet brush 30 and barrel 20.

The top flange 222 of plastic vessel 22 and open top 212 of external metal cylinder 21 are integrally positioned by the following ways.

The top flange 222 of the said plastic vessel 22 is sleeved tightly into the external metal cylinder 21. Referring to FIG. 6, the open top 212 of external metal cylinder 21 can be formed into an internal curling portion 23, which is meshed with the top flange 222 of plastic vessel 22 for positioning purposes. The top flange 222 of plastic vessel 22 is formed into a curling or bending portion, which is embedded into the internal curling portion 23 formed by the open top 212 of external metal cylinder 21. Of which, the top flange 222 of plastic vessel 22 can be embedded into the internal curling portion 23 in several modes. Referring to FIG. 7, the top flange 222 of the plastic vessel 22 can be preset into an outward bending body. When the top flange 222 is punched (or rolled) along with the internal curling portion 23 of open top 212 of external metal cylinder 21, it is also extruded into a S-shaped curling portion 223. Referring also to FIG. 8, the top flange 222 of the plastic vessel 22 can be preset into an inward bending body. When the top flange 222 is rolled along with the internal curling portion 23 of open top 212 of external metal cylinder 21, it is also extruded into a ?-shaped internal curling portion 224. Referring also to FIG. 9, the top flange 222 of the plastic vessel 22 can also be preset into a straight body. When the top flange 222 is punched (or rolled) along with the internal curling portion 23 of open top 212 of external metal cylinder 21, it is also extruded into a bending portion 225.

Referring to FIG. 10, the barrel 20B has an external metal cylinder 21 and a plastic vessel 22, wherein the inner space is expanded so as to use it as a garbage barrel.

DETAILED DESCRIPTION OF THE INVENTION

Figure 1:
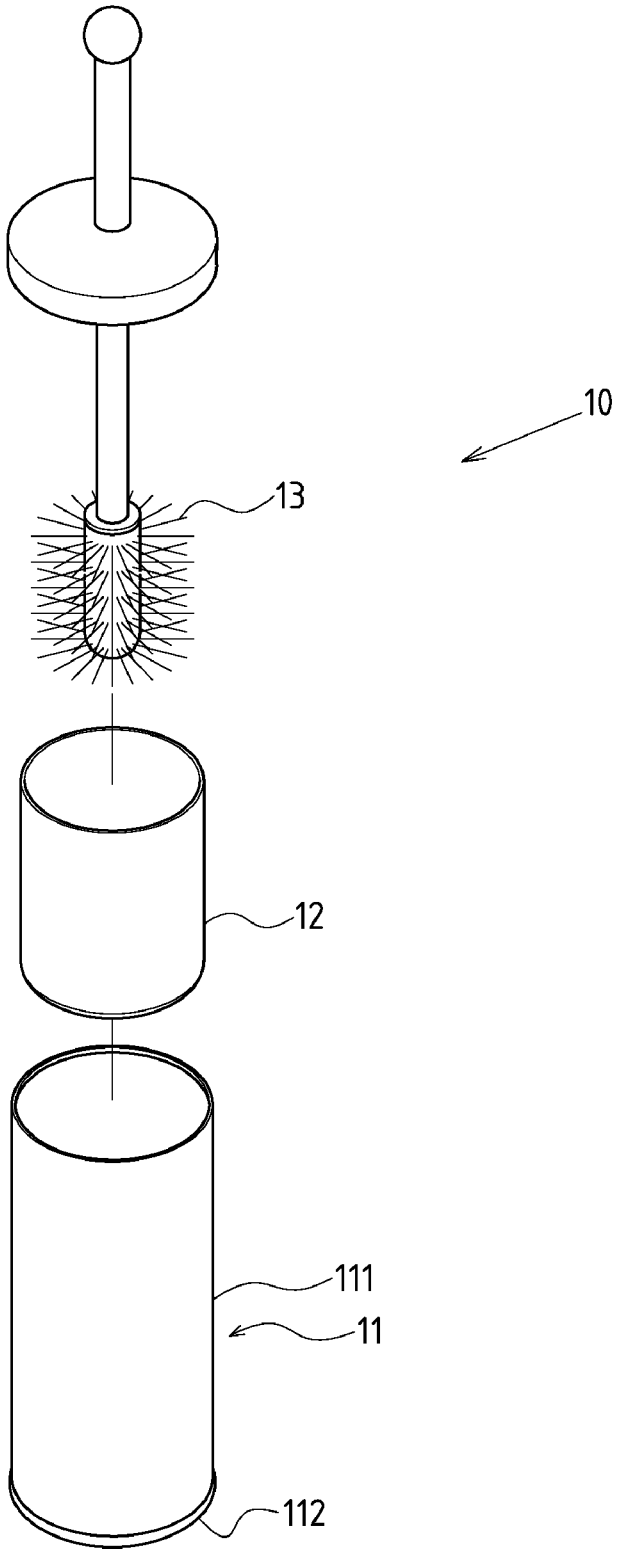
FIG.1 PRIOR ART
FIG. 1 is an exploded perspective view of a typical structure of the prior art.
Figure 2:
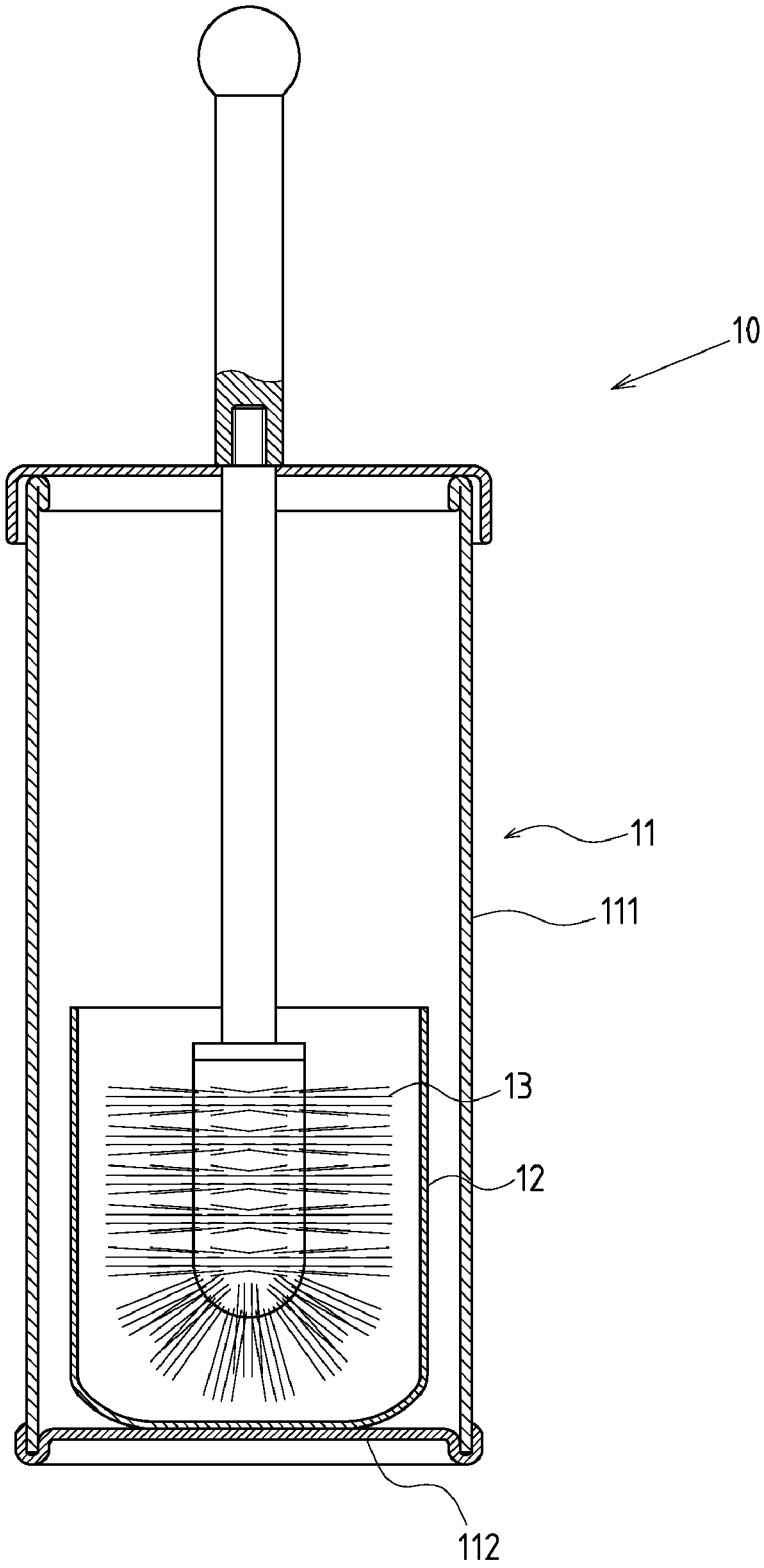
FIG.2 PRIOR ART
FIG. 2 is an assembled sectional view of a typical structure of the prior art.
Figure 3:
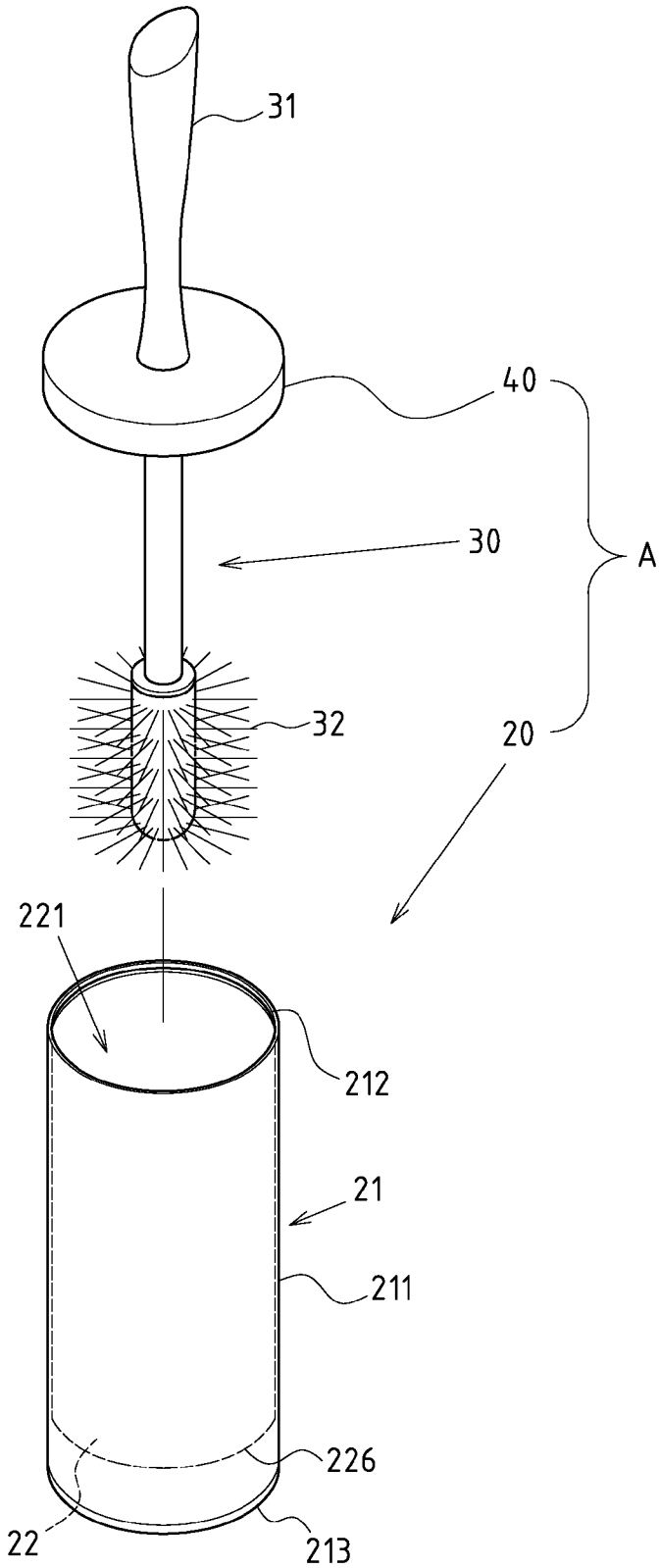
FIG. 3 is an exploded perspective view of preferred embodiment of the present invention.
Figure 4:
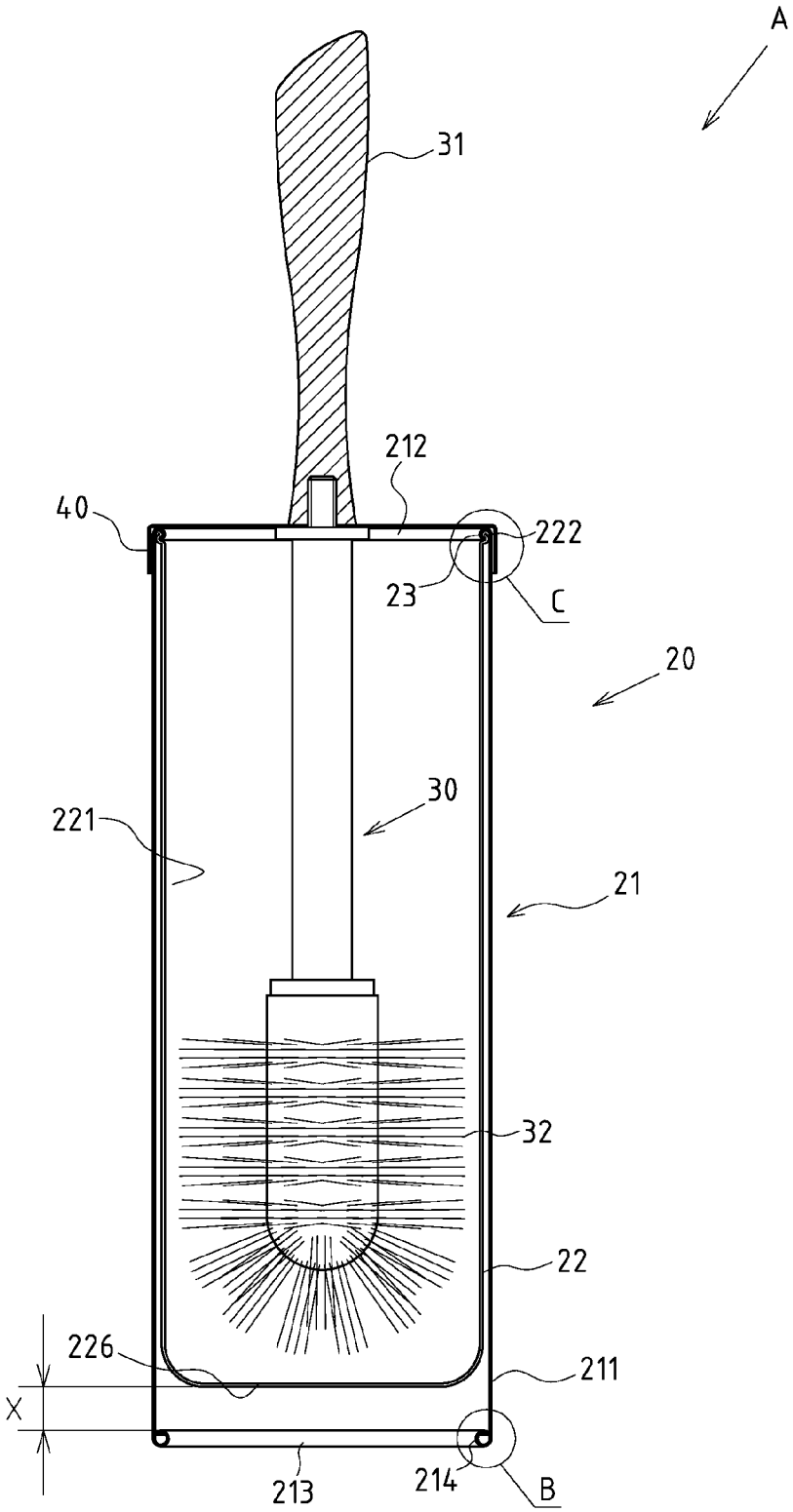
FIG. 4 is an assembled sectional view of preferred embodiment of the present invention.
Figure 5:
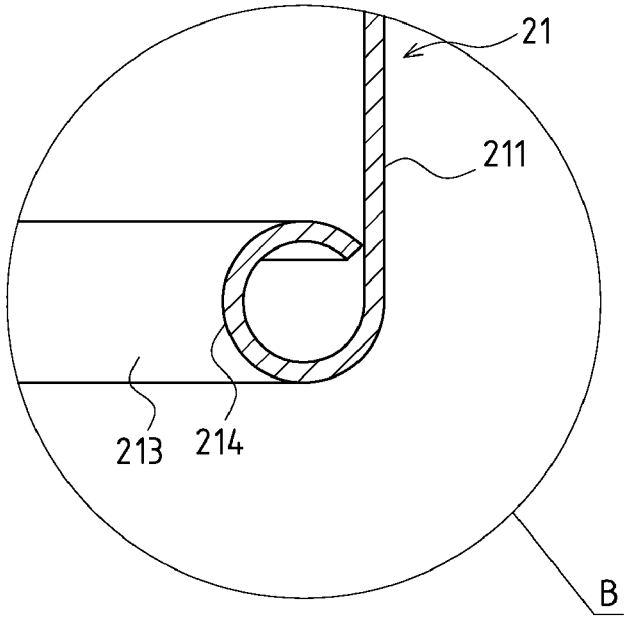
FIG. 5 is an enlarged view of position B of FIG. 4.
Figure 6:
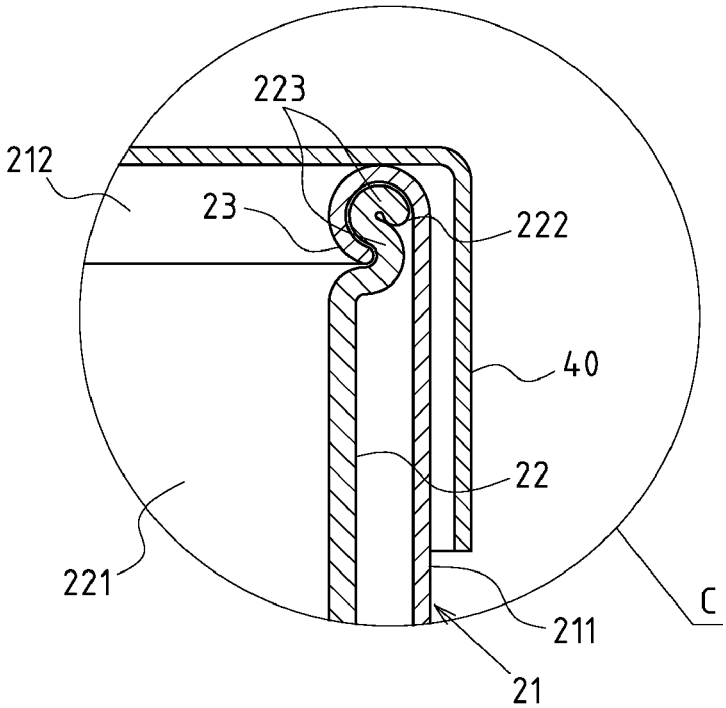
FIG. 6 is an enlarged view of position C of FIG. 4.
Figure 7:
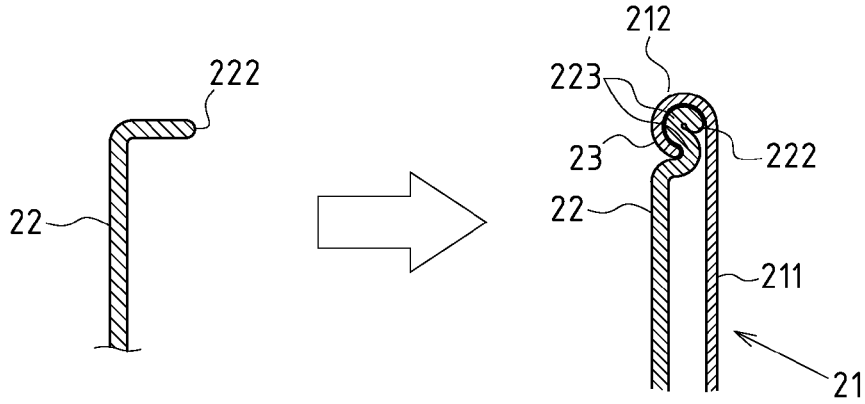
FIG. 7 is a schematic view of a preferred embodiment of the present invention wherein the top flange of plastic vessel and open top of the external metal cylinder are integrally positioned.
Figure 8:
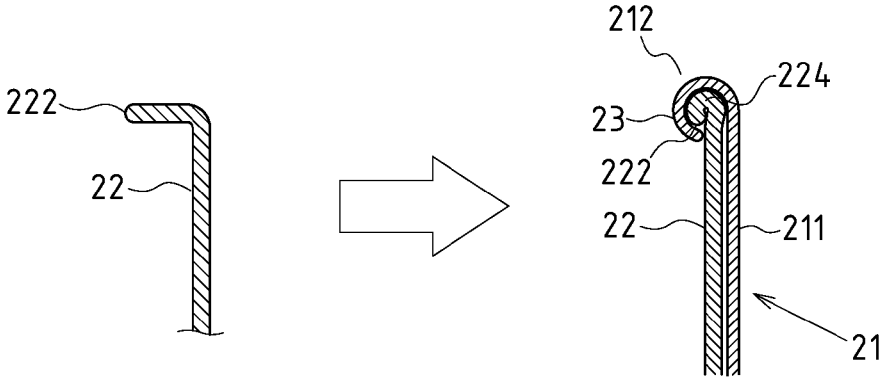
FIG. 8 is a schematic view of second preferred embodiment of the present invention wherein the top flange of plastic vessel and open top of external metal cylinder are integrally positioned.
Figure 9:
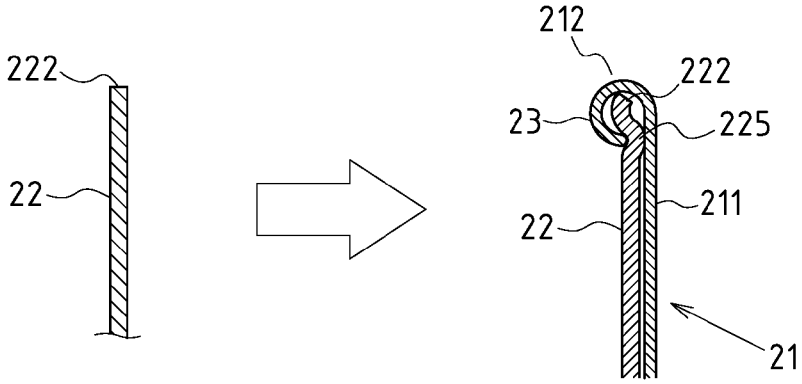
FIG. 9 is a schematic view of third preferred embodiment of the present invention wherein the top flange of plastic vessel and open top of external metal cylinder are integrally positioned.
Figure 10:
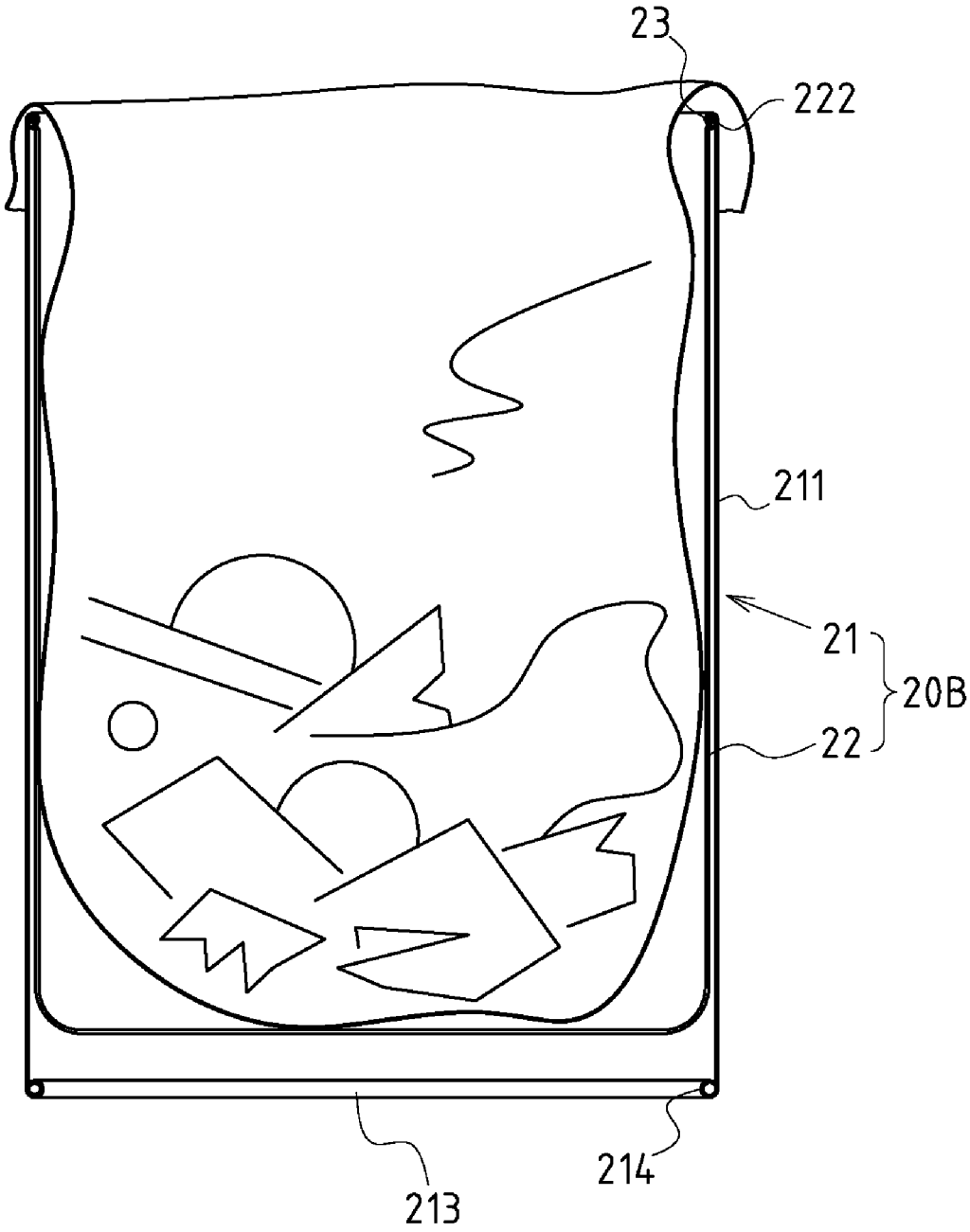
FIG. 10 is a schematic, application view of the present invention wherein the barrel is used as garbage barrel.

Based on the unique configuration of the present invention wherein the top flange of plastic vessel and open top of external metal cylinder are integratedly positioned, and the bottom of external metal cylinder is open-ended, the metal bottom plate of the barrel can be saved, thus reducing the material cost, manufacturing cost and processing procedure with better industrial efficiency.

As the external metal cylinder and plastic vessel are integrated by metal and plastic materials, the sewage released from toilet brush could drop into the plastic vessel, thereby preventing corrosion and extending the life span of products.

Based on the unique construction wherein the top flange of plastic vessel and open top of external metal cylinder are integratedly positioned, the sewage in the barrel can be poured out conveniently, without the need for taking out manually the cup from the barrel.

As the top flange of the plastic vessel is sleeved tightly into the external metal cylinder, and also combined securely with the open top of external metal cylinder, the plastic vessel of the said barrel can be meshed smoothly with the external metal cylinder, thus eliminating the possible dirt accumulation, reducing the cleaning procedures and improving the operational convenience, unlike US Pat. No. 3,800,994.

Based on the technical characteristics wherein a recessed spacing is kept between the plastic vessel's sealed bottom and the curling flange, when the open bottom of the external metal cylinder is curled annularly towards the curling flange, it is possible to avoid frictional damage of the sealed bottom of the plastic vessel by the curling flange. Based on the configuration wherein the top flange of the plastic vessel is positioned by the internal curling portion of the external metal cylinder, the internal curling portions at the top and bottom of the external metal cylinder can be rolled simultaneously, thus improving substantially the production efficiency as compared with US2004/0262171A1.

Although the invention has been explained in relation to its preferred embodiment, it is to be understood that many other possible modifications and variations can be made without departing from the spirit and scope of the invention as hereinafter claimed.

I claim:

1. A barrel comprising:

an external metal cylinder, made of a metal plate, having a cylindrical body without a sealed bottom, and having a through cylinder body with an open top and an open bottom; and an internal curling portion formed annularly onto the top flange of the external metal cylinder; and a curling flange formed annularly onto the flange of the open bottom correspondingly to the internal curling portion;

a plastic vessel, made of plastics, said plastic vessel having a longitudinal length shorter than that of the external metal cylinder; the plastic vessel has an inner space with a sealed bottom;

a through top flange set onto the top flange of the plastic vessel, and formed securely by the internal curling portion of the external metal cylinder;

the top flange of the plastic vessel is sleeved tightly into the external metal cylinder, and can be embedded securely into the internal curling portion on the open top of the external metal cylinder;

the sealed bottom of the plastic vessel is extended into the open bottom of the external metal cylinder, and kept with a recessed spacing to the curling flange, while the bottom of the external metal cylinder is exposed.

2. The structure defined in claim 1, wherein the top flange of plastic vessel is formed into a curling or bending portion to improve the embedding deflection of the internal curling portion formed by the open top of external metal cylinder, and also increase the embedding depth and fastening force of the top flange of the plastic vessel.

3. The structure defined in claim 1, wherein a toilet brush and a cover body are assembled to form a toilet brush assembly; of which the toilet brush comprises of a handle and a brush portion set at one end of the handle; the brush portion can be placed into the inner space of the plastic vessel of the barrel, and the top of the handle is protruded out of the top of the barrel; the said cover body is set at a preset location of the handle of the toilet brush, and can be covered onto the open top of the external metal cylinder of the barrel, thereby positioning the assembly state of the toilet brush and barrel.

* * * * *